United States Patent [19]

Ikenoue et al.

[11] 4,193,804

[45] Mar. 18, 1980

[54] PROCESS FOR PREPARING A COMPOSITION FOR A THERMALLY DEVELOPABLE LIGHT-SENSITIVE MATERIAL

[75] Inventors: Shinpei Ikenoue; Takao Masuda, both of Osaka, Japan

[73] Assignee: Fuji Photo Film Co., Ltd., Minami-ashigara, Japan

[21] Appl. No.: 928,025

[22] Filed: Jul. 25, 1978

[30] Foreign Application Priority Data

Jul. 26, 1977 [JP] Japan ..... 52-89481

[51] Int. Cl.[2] ..... G03C 1/02; G03C 1/72

[52] U.S. Cl. ..... 430/353; 430/30; 430/338; 430/567; 430/569; 430/620

[58] Field of Search ..... 96/94 R, 114.1, 114.6, 96/67, 48 HD

[56] References Cited

U.S. PATENT DOCUMENTS

| | | | |
|---|---|---|---|
| 3,043,570 | 7/1962 | Seiter | 96/94 R X |
| 3,457,075 | 7/1969 | Morgan et al. | 96/67 |
| 3,598,593 | 8/1971 | Klinger | 96/94 R |
| 3,650,757 | 3/1971 | Irie et al. | 96/94 R |
| 3,773,516 | 11/1973 | Gutoff | 96/94 R |
| 3,782,954 | 1/1974 | Porter et al. | 96/94 R |
| 3,817,756 | 6/1974 | Claes et al. | 96/94 R |
| 3,821,002 | 6/1974 | Culhane et al. | 96/94 R |
| 3,885,970 | 5/1975 | Miyahara | 96/94 R |
| 4,030,931 | 6/1977 | Noguchi et al. | 96/114.1 |

FOREIGN PATENT DOCUMENTS

| | | | |
|---|---|---|---|
| 45-12700 | 8/1970 | Japan | 96/114.6 |

*Primary Examiner*—Edward C. Kimlin

*Attorney, Agent, or Firm*—Sughrue, Rothwell, Mion, Zinn and Macpeak

[57] ABSTRACT

A process for preparing a composition for use in a thermally developable light-sensitive material which comprises reacting (a) an organic silver salt with (b) a halogen atom-releasing compound to form a mixture of the organic silver salt and a silver halide wherein the reaction of components (a) and (b) is carried out while controlling the oxidation-reduction potential of the reaction solution. Silver halide grains of a uniform grain size and a narrow grain size distribution can be obtained, and, after (c) a reducing agent is added to the composition, the resulting composition can be used to produce a thermally developable light-sensitive material having superior sensitivity and contrast.

27 Claims, 2 Drawing Figures

PROCESS FOR PREPARING A COMPOSITION FOR A THERMALLY DEVELOPABLE LIGHT-SENSITIVE MATERIAL

BACKGROUND OF THE INVENTION

1. Field of the Invention

This invention relates to a process for preparing a composition for a thermally developable light-sensitive material. More specifically, the invention relates to a process for preparing a thermally developable light-sensitive composition having a high sensitivity and a high contrast in which the size of the silver halide grains is controlled and the end point of the decomposition of the halogen atom-releasing compound can be accurately detected by reacting an organic silver salt with a halogen atom-releasing compound to form a silver halide in intimate contact with the surface of the organic silver salt while controlling the oxidation-reduction potential of the reaction solution.

2. Description of the Prior Art

The thermally developable light-sensitive materials described, for example, in U.S. Pat. Nos. 3,152,904 and 3,457,075 are composed of a composition consisting essentially of an organic silver salt, a small amount of a silver halide and a reducing agent. Since they need only to be merely heated to at least 80° C. after imagewise exposure to produce images, they are attracting attention as light-sensitive materials which can be processed completely in the dry state.

Of the methods for preparing a composition comprising a mixture of an organic silver salt, a small amount of a silver halide and a reducing agent for use in such a thermally developable light-sensitive material, the method described in U.S. Pat. No. 3,457,075 is superior to other methods because this method can be used to produce a silver halide which is in close proximity to the organic silver salt. This method comprises reacting a separately prepared organic silver salt with a small amount of a halogenating agent to convert a part of the organic silver salt into the corresponding silver halide and then adding a reducing agent to the mixture of the organic silver salt and the silver halide to form a composition for use in a thermally developable light-sensitive material (to be referred to hereinafter as a "halidizing method").

With this halidizing method, it is difficult to control the properties of the silver halide, for example, the silver halide grain size distribution, as desired. Since the starting materials, reaction solvents, materials such as a protective polymer, and other reaction conditions which are used in forming silver halide drastically differ from the materials and reaction conditions used for conventional gelatin-silver halide emulsions, the techniques and knowledge that have been built up in the field of producing gelatin-silver halide emulsions can only in certain instances be applied to thermally developable light-sensitive materials.

Further, various halogenating agents can be used in the above-described halidizing method. However, when a halogen atom-releasing compound (i.e., a compound capable of releasing a halogen atom or a radical containing a halogen when the compound is dissolved in a reaction medium and decomposition is accelerated such as by heating, etc.) other than a compound which completely dissociates in a reaction medium and releases a halogen ion (e.g., a metal halide or hydrogen halide) is used, whether or not the compound is completely decomposed must be confirmed. This is because if the decomposition of the compound is insufficient, the amount of a silver halide formed is relatively small and the compound which remains in the system without being decomposed has a function of cleaving spectrally sensitizing dyes for silver halide, which results in a reduction in the light-sensitivity of the thermally developable light-sensitive material. Further, it is also known that when the amount of the halogen atom-releasing compound remaining is large, a reduction of the contrast occurs in proportion thereto.

In order to prevent these drawbacks, in the conventionally employed halidizing method using a halogen atom-releasing compound since the halogen atom-releasing compound has the property of cleaving the spectrally sensitizing dye, a certain type of a merocyanine dye is added to the reaction solution, and sufficient decomposition of the halogen atom-releasing compound is confirmed by discoloration of the merocyanine dye. However, this is not a method for sufficiently and quantitatively confirming the decomposition of the halogen atom-releasing compound, and further, this method has various drawbacks that the results obtained vary depending upon the amount of the merocyanine dye added, and the structure of the merocyanine dye, and that an expensive merocyanine dye must be used. However, if such a halogen atom-releasing compound is merely decomposed to a sufficient extent, a thermally developable light-sensitive material which has a low degree of fogging and a high contrast as compared with a thermally developable light-sensitive material using a halogen ion-releasing compound can be obtained.

SUMMARY OF THE INVENTION

Extensive studies have now been made on a method of producing a silver halide having the desired grain size distribution by the halidizing technique, and it has been found that this can be achieved by controlling the oxidation-reduction potential of the reaction solution.

While it is known that the grain size distribution of silver halide can be adjusted by controlling the pAg of the reaction solution during production of a gelatin-silver halide emulsion, it has been quite unknown that the grain size distribution of silver halide for thermally developable light-sensitive materials can be controlled by controlling the oxidation-reduction potential of the reaction solution. The discovery of this phenomenon is thus surprising.

It has also now been found that whether or not the halogen atom-releasing compound has been sufficiently decomposed can be simply confirmed using accurate and quantitiative information obtained by measuring the oxidation-reduction potential of the reaction solution.

An object of this invention is to provide a composition for use in a thermally developable light-sensitive material by the halidizing method which permits the control of the size of the resulting silver halide grains.

Another object of this invention is to provide a composition for a thermally developable light-sensitive material using the halidizing method in which a silver halide having a narrow grain size distribution can be produced.

A further object of this invention is to provide a method of producing a composition for a thermally developable light-sensitive material wherein simple and accurate detection of whether the halogen atom-releasing compound is sufficiently decomposed is possible.

These objects are achieved in accordance with one embodiment of this invention by a process for preparing a composition for use in a thermally developable light-sensitive material which comprises reacting (a) an organic silver salt with (b) a halogen atom-releasing compound to form a mixture of the organic silver salt and a silver halide, wherein the reaction of component (a) with component (b) is carried out while controlling the oxidation-reduction potential of the reaction solution.

In another embodiment of this invention, these objects are achieved by a process for preparing a composition for use in a thermally developable light-sensitive material which comprises reacting (a) an organic silver salt with (b) a halogen atom-releasing compound to form a mixture of the organic silver salt and a silver halide, wherein the reaction of component (a) with component (b) is carried out while controlling the oxidation-reduction potential of the reaction solution; and adding (c) a reducing agent to the mixture of the organic silver salt and the silver halide.

BRIEF DESCRIPTION OF THE ACCOMPANYING DRAWINGS

DETAILED DESCRIPTION OF THE INVENTION

Figure 1:
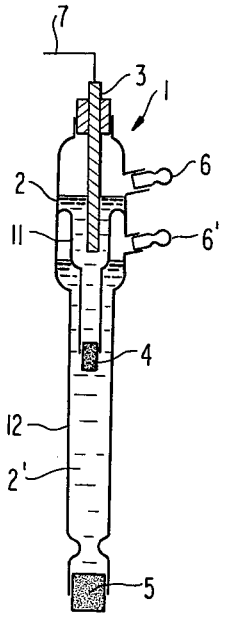
FIG. 1 shows an example of a reference electrode used in this invention.

The organic silver salt (a) used in this invention is a silver salt of an organic compound containing an imino group, a mercapto group, a thione group or a carboxyl group. Specific examples of organic silver salts are given below.

(1) Examples of silver salts of organic compounds having an imino group:

Silver salts of benzotriazoles, silver salt of saccharin, silver salts of phthalazinones, and silver salts of phthalamides as disclosed in U.S. Pat. No. 4,039,334.

(2) Examples of silver salts of organic compounds having a mercapto or thione group:

Silver salt of 2-mercaptobenzoxazole, silver salt of mercaptoxadiazole, silver salt of 2-mercaptobenzothiazole, silver salt of 2-mercaptobenzimidazole, and silver salt of 3-mercapto-4-phenyl-1,2,4-triazole disclosed, for example, in Japanese Patent Application (OPI) No. 22431/76 (The term "OPI" as used herein refers to a "published unexamined Japanese patent application".) and U.S. Pat. Nos. 3,933,507 and 3,785,830.

(3) Examples of silver salts of organic compounds having a carboxyl group:

(a) Silver salts of aliphatic carboxylic acids:

Silver laurate, silver myristate, silver palmitate, silver stearate, silver arachidonate, silver behenate, silver salts of aliphatic carboxylic acids having at least 23 carbon atoms (such as silver tricosanate, silver lignocerate, silver pentacosanate, silver cerotate, silver montanate, etc.), silver adipate, silver sebacate, and silver hydroxystearate disclosed, for example, in Japanese Patent Application (OPI) Nos. 22431/76 and 99719/75 and U.S. Pat. No. 3,457,075.

(b) Silver salts of aromatic carboxylic acids:

Silver benzoate, silver phthalate, silver phenylacetate, and silver 4'-n-octadecyloxydiphenyl-4-carboxylate disclosed, for example, in Japanese Patent Application (OPI) Nos. 22431/76 and 99719/75.

(4) Examples of other silver salts:

Silver salt of 4-hydroxy-6-methyl-1,3,3a,7-tetrazaindene, and silver salt of 5-methyl-7-hydroxy-1,2,3,4,5-pentazaindene disclosed, for example, in Japanese Patent Application (OPI) Nos. 22431/76 and 93139/75.

The most preferred organic silver salts for use in this invention are silver salts of straight chain fatty acids having at least 12 carbon atoms.

The halogen atom-releasing compound, component (b), used in this invention can be organic compounds containing a halogen atom bonded to a nitrogen atom (hereinafter "N-halo compounds") or organic compounds containing a halogen atom bonded to a carbon atom (hereinafter "C-halo compounds"). Suitable examples of N-halo compounds and C-halo compounds which can be used are shown below.

N-halo compounds especially suitable for this invention include compounds of the following general formula (I) and (II):

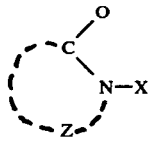

(I)

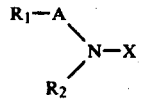

(II)

In these general formulae (I) and (II), X represents Cl, Br or I.

In general formula (I), Z represents the non-metallic atoms necessary to form a 4- to 8-membered ring, such as hydrogen atoms, carbon atoms, nitrogen atoms, and/or oxygen atoms. the 4- to 8-membered ring may be fused to another ring. Preferably, Z represents a 5- or 6-membered ring. Specific examples of 5- or 6-membered rings formed by Z are pyrrole, pyrroline, pyrrolidine, imidaline, imidazolidine, pyrazoline, oxazolidine, piperidine, oxazine, piperazine, and indoline rings. Z may form a 4- to 8-membered lactam ring. Furthermore, Z may form a hydantoin, cyanuric, hexahydrotriazine or indoline ring. The ring formed by Z may also be substituted with one or more of an alkyl group, an aryl group, an alkoxy group, a halogen atom, or an oxo group (=O) as substituents. Suitable alkyl groups preferably have 1 to 12 carbon atoms, more preferably 1 to 8 carbon atoms, and examples include, for example, an ethyl group, a propyl group, an isopropyl group, a butyl group, an isobutyl group, a t-butyl group, a pentyl group, a hexyl group, a 2-ethylhexyl group, an octyl group, a nonyl group, a decyl group and a dodecyl group. Preferred aryl groups are a phenyl group and a naphthyl group which may be either unsubstituted or substituted with one or more of, preferably, an alkyl group having 1 to 4 carbon atoms such as a methyl group, an ethyl group, a propyl group, an isopropyl group, a butyl group or a t-butyl group, or a halogen atom such as a chlorine atom, a bromine atom or an iodine atom. Suitable alkoxy groups preferably have 1 to 12 carbon atoms, more preferably 1 to 8 carbon atoms, and examples include, for example, a methoxy group, an ethoxy group, a propoxy group, an isopropoxy group, a butoxy group, a t-butoxy group, a pentoxy group, a hexoxy group, an octoxy group and a dodecoxy group.

In the general formula (II), A represents a carbonyl group or a sulfonyl group, $R_1$ and $R_2$, which may be the same or different, each represents a hydrogen atom, an alkyl group, an aryl group or an alkoxy group. Suitable alkyl and alkoxy groups for $R_1$ and $R_2$ preferably have 1 to 12 carbon atoms, more preferably 1 to 8 carbon atoms. Specific examples of suitable alkyl and alkoxy groups for $R_1$ and $R_8$ are as described herein-before for the alkyl and alkoxy groups as substituents on the ring formed by Z. Preferred aryl groups are unsubstituted phenyl and naphthyl groups or substituted phenyl and naphthyl groups which can be substituted with one or more of, for example, an alkyl group having 1 to 4 carbon atoms (such as methyl, ethyl, propyl, butyl, isopropyl), an alkoxy group having 1 to 4 carbon atoms (such as methoxy, ethoxy, propoxy, butoxy, etc.) or a halogen atom (such as Cl, Br or I).

Halogenated melamines are also suitable N-halo compounds for use as component (b) in this invention.

Specific examples of preferred N-halo compounds for use as component (b) in this invention are listed below.

(1) N-Bromosuccinimide;
(2) N-Bromotetrafluorosuccinimide;
(3) N-Bromophthalimide;
(4) N-Bromoglutarimide;
(5) 1-Bromo-3,5,5-trimethyl-2,4-imidazolidinedione;
(6) 1,3-Dibromo-5,5-dimethyl-2,4-imidazolidinedione;
(7) N,N'-Dibromo-5,5-diethylbarbituric acid;
(8) N,N'-Dibromobarbituric acid;
(9) N-Bromoisocyanuric acid;
(10) N-Bromoacetamide;
(11) N-Bromochloroacetamide;
(12) N-Bromotrifluoroacetamide;
(13) N-Bromoacetanilide;
(14) N-Bromobenzenesulfonylanilide;
(15) N-Bromobenzamide;
(16) N-Bromobenzenesulfonylamide;
(17) N-Bromo-N-benzenesulfonyl benzenesulfonylamide;
(18) N-Bromophthalazone
(19) N-Chlorosuccinimi
(20) N-Iodosuccinimide;
(21) Trichloroisocyanuric acid;
(22) N-Chlorophthalimide
(23) 1,3-Dichloro-5,5-dimethyl-2,4-imidazolidinedione;
(24) 3-Chloro-5,5-dimethyl-2,4-imidazolidinedione;
(25) 1,3-Iodo-5,5-dimethyl-2,4-imidazolidinedione;
(26) Trichloromelamine;
(27) Tribromomelamine;
(28) N-Bromocyclohexanedicarbonimide;
(29) 1-Bromo-3,5,5-triethyl-2,4-imidazolidinedione;
(301-Bromo-3-ethyl-5,5-dimethyl-2,4-imidazolidinedione;
(31) 1,3-Dibromo-5,5-diethyl-2,4-imidazolidinedione;
(32) N,N-Dibromo-5,5-dimethylbarbituric acid;
(33) N,N-Dibromo-5-ethyl-5-methylbarbituric acid;
(34) N,N-Dibromo-5-ethyl-5-phenylbarbituric acid;
(35) N,N'-Dibromoisocyanuric acid;
(36) N-Bromoacetamide;
(37) N-Bromonaphthamide;
(38) N-Bromohydroxybenzamide;
(39) N-Bromocarboxybenzamide;
(40) N-Bromotoluenesulfonamide;
(41) N-Bromo-N-toluenesulfonyl toluenesulfonylamide;
(42) N-Bromosaccharin;
(43) N-Bromocaprolactam;
(44) N-Bromobutyrolactam;
(45) N-Bromovalerolactam;
(46) N-Bromopropiolactam.

Suitable C-halo compounds for use in this invention include compounds of the following general formula (III):

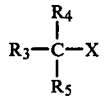

(III)

In the general formula (III) X represents Cl, Br or I.

In general formula (III), $R_3$, $R_4$ and $R_5$, which may be the same or different, each represents a member selected from the group consisting of a hydrogen atom; alkyl groups having 1 to 10 carbon atoms including alkyl groups (such as a methyl group, an ethyl group, a propyl group, a butyl group, a t-butyl group, an octyl group, etc.) and substituted alkyl groups such as hydroxyalkyl groups (such as a hydroxymethyl group, a hydroxypropyl group, etc.), nitroalkyl groups (such as a nitromethyl group, a nitroethyl group, etc.) or acyloxyalkyl groups (such as an acetoxymethyl group, an acetoxyethyl group, a benzoyloxymethyl group, etc.); aryl groups having 6 to 14 carbon atoms including unsubstituted aryl groups (such as a phenyl group or a naphthyl group) and substituted aryl groups such as nitroaryl groups (such as a nitrophenyl group, a nitronaphthyl group, etc.), haloaryl groups (such as a bromophenyl group, a chlorophenyl group, etc.) or alkaryl groups (such as a tolyl group, a butylphenyl group, etc.); acyl groups of the formula $R_6$—CO— in which $R_6$ represents an alkyl group having 1 to 10 carbon atoms including unsubstituted alkyl groups (such as a methyl group, an ethyl group, a propyl group, a butyl group, a t-butyl group, an actyl group, etc.) and substituted alkyl groups such as a haloalkyl group (such as a bromomethyl group, a bromoethyl group, a chloropropyl group, etc.), or an aryl group having 6 to 14 carbon atoms including unsubstituted aryl groups (such as a phenyl group or a naphthyl group) and substituted aryl groups such as a haloalkaryl group (such as a (bromomethyl) phenyl group, a (bromoethyl) naphthyl group, etc.) or an alkoxyaryl group (such as a methoxyphenyl group, an ethoxyphenyl group, a butoxyphenyl group, etc.); amido groups represented by the formula

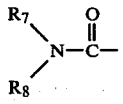

in which $R_7$ and $R_8$, which may be the same or different, each represents a hydrogen atom, an alkyl group having 1 to 10 carbon atoms (such as a methyl group, an ethyl group, a propyl group, a butyl group, a t-butyl group, an octyl group, etc.), or an aryl group having 6 to 14 carbon atoms including unsubstituted aryl groups (such as a phenyl group or a naphthyl group) and substituted aryl groups such as a haloaryl group (such as a bromophenyl group, a chlorophenyl group, etc.); and sulfonyl groups of the formula $R_9$—$SO_2$— in which $R_9$ represents an alkyl group having 1 to 10 carbon atoms (e.g., as described for $R_7$), or an aryl group having 6 to 14 carbon atoms including unsubstituted aryl groups (such as a phenyl group or a naphthyl group) and substituted aryl groups such as an alkaryl group (such as a tolyl group, a butylphenyl group, etc.). At least one $R_3$, $R_4$ and $R_5$ is a group which promotes the release of a halogen atom (to be referred to hereinafter as an activating group). Specific examples of activating groups include a nitro group, aryl groups including unsubstituted aryl groups (such as a phenyl group or a naphthyl group) and substituted aryl groups such as nitroaryl groups (such as a nitrophenyl group, a nitronaphthyl group, etc.), haloaryl groups (such as a bromophenyl group, a chlorophenyl group, etc.) and alkaryl groups (such as a tolyl group, a butylphenyl group, etc.), acyl groups (such as an acetyl group, a propionyl group, a butyryl group, etc.), amido groups (such as an acetamido group, a propionamido group, a benzamido group, etc.), and sulfonyl groups.

Of the compounds of the general formula (III), α-haloketones or α-haloamides of the following general formula (IV) are preferred.

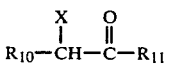

(IV)

wherein X represents Cl, Br or I; $R_{10}$ represents a hydrogen atom, an alkyl group having 1 to 10 carbon atoms including a substituted alkyl group such as a nitroalkyl group (such as a methyl group, an ethyl group, a propyl group, a butyl group, a pentyl group or an actyl group), an acyl group having 1 to 10 carbon atoms (such as an acetyl group, a propionyl group, a butyryl group, a pentanoyl group or a benzoyl group), or an aryl group having 6 to 14 carbon atoms including unsubstituted aryl groups (such as a phenyl group or a naphthyl group) and substituted aryl groups such as a nitroaryl group (such as a nitrophenyl group, a nitronaphthyl group, etc.), a haloaryl group (such as a bromophenyl group, a chlorophenyl group, etc.) or an alkaryl group (such as a tolyl group, a butylphenyl group, etc.); and $R_{11}$ represents an amino group, an alkyl group having 1 to 10 carbon atoms including unsubstituted alkyl groups (such as a methyl group, an ethyl group, a propyl group, a butyl group, a t-butyl group, an octyl group, etc.) and substituted alkyl groups such as a haloalkyl group (such as a bromomethyl group, a bromoethyl group, a chloropropyl group, etc.), or an aryl group having 6 to 14 carbon atoms including unsubstituted aryl groups (such as a phenyl group or a naphthyl group) and substituted aryl groups such as a haloaryl group (such as a bromophenyl group, a chlorophenyl group, etc.) or an alkoxyaryl group (such as a methoxyphenyl group, an ethoxyphenyl group, a butoxyphenyl group, etc.).

Of the compounds of the general formula (III), halosulfonyl compounds of the following general formula (V)

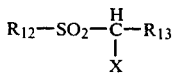

(V)

wherein X represents Cl, Br or I; $R_{12}$ represents an aryl group having 6 to 12 carbon atoms (such as a phenyl group, a tolyl group or a naphthyl group); and $R_{13}$ represents a hydrogen atom, an alkyl group having 1 to 5 carbon atoms (such as a methyl group, an ethyl group or a propyl group), or an amido group of the formula

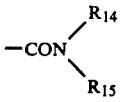

in which $R_{14}$ and $R_{15}$, which may be the same or different, each represents a hydrogen atom, an alkyl group having 1 to 5 carbon atoms (such as a methyl group, an ethyl group, a propyl group, an isopropyl group, a butyl group, etc.), a phenyl group, or a tolyl group; are also preferred.

Another group of preferred compounds of formula (III) includes halonitro lower alkane compounds of the following general formula (VI):

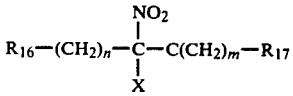

(VI)

wherein X represents Cl, Br or I; m and n are integers of 1 to 5; and $R_{16}$ and $R_{17}$, which may be the same or different, each represents a hydroxyl group, or an ester group or a sulfonyl group of the following formulae

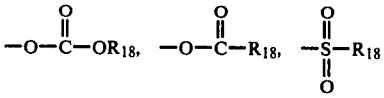

in which $R_{18}$ represents an aryl group having 6 to 12 carbon atoms (such as a phenyl group, a tolyl group or a naphthyl group), or an alkyl group having 1 to 5 carbon atoms (such as a methyl group, an ethyl group, a propyl group or a butyl group).

Specific examples of compounds of the general formula (III) are listed below.

(47) 2-Bromo-2-phenylsulfonyl acetamide;
(48) 2-Bromoacetophenone;
(49) α-Chloro-p-nitrotoluene;
(50) 2-Bromo-2-phenylacetophenone;
(51) 2-Bromo-1,3-diphenyl-1,3-propanedione;
(52) α-Bromo-2,5-dimethoxyacetophenone;
(53) α-Bromo-γ-nitro-β-phenylbutyrophenone;
(54) 2-Bromo-2-p-tolylsulfonyl acetamide
(55) α-Iodo-γ-nitro-γ-phenylbutyrophenone;
(56) α-Bromo-p-nitrotoluene;
(57) 2-Bromo-4'-phenylacetophenone;
(58) 2-Chloro-4'-phenylacetophenone;
(59) α-Bromo-m-nitrotoluene;
(60) 2-Bromo-2-nitro-1,3-propanediol;
(61) 1,3-Dibenzoyloxy-2-bromo-2-nitropropane;
(62) 2-Bromo-2-nitrotrimethylenebis(phenyl carbonate);

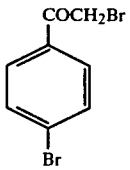

(63)

(64)

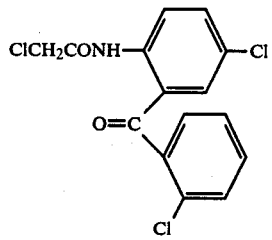

(65) $ClCH_2CONH_2$ (66)

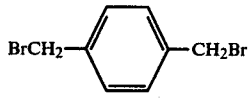

(67)

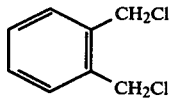

(68)

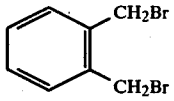

Of these N-halo compounds and C-halo compounds, compounds capable of releasing a bromine atom are preferred.

Generally, the effect of controlling the oxidation-reduction potential is greater where N-halo compounds are used than is the case where C-halo compounds are used. Accordingly, N-halo compounds are especially suitable halogen atom-releasing compounds for use as component (b) in this invention.

According to this invention, the reaction of converting a part of component (a) into a silver halide by mixing the organic silver salt (a) with the halogen atom-releasing compound (b) is carried out while controlling the oxidation-reduction potential of the reaction solution.

Component (b) is used in an amount stoichiometrically less than component (a). Generally, the amount of component (b) is about 0.005 mole to about 0.5 mole, preferably about 0.01 mole to about 0.3 mole, per mole of component (a).

Examples of silver halides which can be formed by the reaction of components (a) and (b) include silver chloride, silver bromide, silver iodide, silver chlorobromide, silver iodobromide, and silver chloroiodobromide.

The reaction between components (a) and (b) can be induced by mixing them in the presence of a suitable reaction solvent. Preferably, the mixture is heated and/or a reaction promotor is added.

Water can be used as the reaction solvent, but in many cases, the use of organic solvents is preferred since component (b) is more readily soluble in organic solvents than in water.

Suitable organic solvents which can be used in this invention are organic solvents which are normally liquid compounds, which contain mainly carbon atoms and hydrogen atoms but may also contain an oxygen, sulfur or nitrogen atom, and which have a boiling point at normal pressure about 165° C. or less, preferably about 90° C. or less. Examples of suitable organic solvents are alcohols, ketones, aromatic hydrocarbons, aliphatic unsaturated hydrocarbons, esters and ethers.

Specific examples of suitable organic solvents are listed below:

(a) Alcohols

For example, saturated aliphatic alcohols such as methyl alcohol, ethyl alcohol, propyl alcohol, isopropyl alcohol, butyl alcohol, isobutyl alcohol, sec-butyl alcohol, tert-butyl alcohol, amyl alcohol, isoamyl alcohol and hexyl alcohol; unsaturated aliphatic alcohols such as allyl alcohol, crotyl alcohol and propargyl alcohol; alicyclic alcohols such as cyclopentanol and cyclohexanol; aromatic alcohols such as benzyl alcohol and cinnamyl alcohol; and heterocyclic alcohols such as furfuryl alcohol.

(b) Ketones

For example, saturated aliphatic ketones such as acetone, methyl ethyl ketone, methly propyl ketone, methyl isopropyl ketone, methyl butyl ketone, methyl isobutyl ketone, pinacolone, butyrone and diisopropyl ketone; unsaturated ketones such as methyl vinyl ketone, mesityl oxide and methylheptenone; alicyclic ketones such as cyclobutanone, cyclopentanone and butyrophenone; and aromatic ketones such as acetophenone, propiophenone and butyrophenone.

(c) Esters

For example, carboxylic acid esters and the like. Preferred carboxylic acids of the carboxylic acid esters are organic carboxylic acids having 1 to 12 carbon atoms such as saturated aliphatic carboxylic acids, unsaturated aliphatic carboxylic acids, and aromatic carboxylic acids. Examples of alcohols of the esters are alcohols having 1 to 10 carbon atoms, especially aliphatic alcohols. The alcohols may be monohydric or polyhydric. Glycerol is an example of a polyhydric alcohol. Specific examples of suitable carboxylic acid esters are methyl formate, ethyl formate, propyl formate, isobutyl formate, n-amyl formate, isoamyl formate, methyl acetate, ethyl acetate, isopropyl acetate, butyl acetate, isobutyl acetate, n-amyl acetate, isoamyl acetate, methyl propionate, ethyl propionate, propyl propionate, isopropyl propionate, butyl propionate, isobutyl propionate, n-amyl propionate, isoamyl propionate, methyl butyrate, ethyl butyrate, isopropyl butyrate, methyl isobutyrate, ethyl isobutyrate, isoamyl isobutyrate, methyl isovalerate, ethyl isovalerate, propyl isovalerate, isopropyl isovalerate, methyl benzoate, and butyl phthalate.

(d) Ethers

For example, aliphatic ethers such as diethyl ether, dipropyl ether, di-isopropyl ether, dibutyl ether, di-isobutyl ether, methyl isopropyl ether, methyl butyl ether, methyl isobutyl ether, methyl n-amyl ether, methyl isoamyl ether, ethyl propyl ether, ethyl isopropyl ether, ethyl butyl ether, and ethyl isoamyl ether; aliphatic unsaturated ethers such as diallyl ether, dimethylallyl ether and ethyl allyl ether; aromatic ethers such as anisole, phenetole and diphenyl ether; and cyclic ethers such as trimethylene oxide, tetrahydrofuran, tetrahydropyran and dioxane.

(e) Aliphatic unsaturated hydrocarbons

For example, cyclohexene, dodecene, cycloheptene, cyclopentadiene, cyclopentene, cycloheptadiene, cyclooctatetraene, cyclohexadiene, decene and tetradecene.

(f) Aromatic hydrocarbons

For example, benzene, toluene, xylene, indene and tetralin.

(g) Cycloalkanes and cycloalkenes

For example, cyclooctane, cyclohexene, cycloheptane and cyclopentene.

(g) Solvents containing a nitrogen or sulfur atom

For example, acetonitrile, dimethyl sulfoxide, dimethylformamide and dimethylacetamide.

Components (a) and (b) are used dispersed or dissolved in an organic solvent as described above. A dispersion of component (a) in an organic solvent will be referred to hereinbelow as Liquid (I), and a dispersion or solution of component (b) in an organic solvent will be referred to hereinbelow as Liquid (II). The concentration of Liquid (I) or (II) can be set as desired. Usually, the concentration is adjusted to about $10^{-3}$% by weight to about $3\times10^{-2}$% by weight, especially about $10^{-2}$% by weight to about $10^{2}$% by weight.

The use of a substance which promotes the reaction between component (a) and component (b) (hereinafter reaction promoter) is preferred also in performing the process of this invention. Examples of suitable reaction promoters are the alcohols described in Japanese Patent Application (OPI) No. 115027/75. The alcohols act to promote the decomposition of component (b). Primary alcohols and secondary alcohols are preferred for use in this invention. Especially preferred are those alcohols which are liquid at low temperatures (about 30° C.). In particular, suitable alcohols have up to 8 carbon atoms. These alcohols may also contain other atoms such as nitrogen or oxygen in addition to carbon and hydrogen.

Examples of preferred alcohols include methanol, ethanol, n-propanol, isopropanol, 1-butanol, 1-heptanol, 1-octanol, β-phenylethyl alcohol, furfuryl alcohol, pyridyl carbinol, 2-octanol, α-phenylethyl alcohol, pyridylethyl alcohol, cyclohexanol, allyl alcohol, benzyl alcohol, isobutyl alcohol, sec-butyl alcohol, crotyl alcohol, and cyclopentanol.

Two or more alcohols may be used in combination as a reaction promoter. The combined use of the alcohols with water or other solvents is also suitable. If an alcohol is used as a solvent for Liquid (I), it is not necessary to add a reaction promoter separately. The amount of the alcohol as the reaction promoter is determined mainly on the basis of component (b). The ratio of the alcohol to component (b) can be varied over a wide range. Generally, the alcohol is used in an amount of at least one mole, preferably at least 10 moles, per mole of component (b). Generally, up to about $10^{6}$ moles per mole can be used, but larger amounts may be used if desired.

Liquids (I) and (II) and the alcohol may be mixed in any desired sequence. For example, (1) Liquids (I) and (II) and the alcohol may be added simultaneously to a reactor; (2) Liquid (I) may be placed in a reactor, and Liquid (II) and the alcohol are then added to the reactor; (3) Liquids (I) and (II) may be placed in a reactor, and then the alcohol is added; or (4) Liquid (I) and the alcohol may be placed in a reactor, and then Liquid (II) is added to the reactor. Mixing sequences (2) and (4) described above are preferred, and mixing sequence (4) produces an especially superior result.

The term "oxidation-reduction potential of the reaction solution" as used herein denotes the equilibrium electrode potential of an oxidation-reduction potential measuring system prepared by inserting a reference electrode and a measuring electrode in a solution or dispersion containing components (a) and (b). In the present invention, the oxidation-reduction potential will vary depending on the concentration of halogen atoms in the reaction solution and the concentration of component (b). By controlling the oxidation-reduction potential of the reaction solution, the concentration of halogen atoms in the reaction solution and the concentration of component (b) can be accurately controlled. Thus, the size of the silver halide grains and the silver halide grain size distribution can be varied as desired. Further, by continuously measuring the oxidation-reduction potential subsequent to the completion of the mixing of components (a) and (b), the end when component (b) has been sufficiently decomposed can be detected.

Control of the oxidation-reduction potential of the reaction solution can be achieved using various methods. For example, the control can be achieved by increasing or decreasing the rate of addition of component (b) to the reaction solution, by increasing or decreasing the rate of addition of the alcohol to the reaction mixture, or by heating or cooling the reaction solution. The oxidation-reduction potential of the reaction solution can be controlled using these procedures, either alone or taken together. Of these procedures, a relatively effective method of controlling the oxidation-reduction potential is to increase or decrease the rate of addition of the component (b) and the alcohol to the reaction solution. Specifically, this method involves adding Liquid (I) to a reactor in advance, succesively adding Liquid (II) and the alcohol, during which time the oxidation-reduction potential of the solution in the reactor is measured and the value is controlled. The most effective method which can be used to control the oxidation-reduction potential is to increase or decrease the rate of addition of component (b) to the reaction solution. This method involves feeding Liquid (I) and the alcohol into the reactor in advance and successively adding Liquid (II), during which time the oxidation-reduction potential of the solution in the reactor is measured and the value is controlled. The oxidation-reduction potential of the reaction solution increases on addition of component (b), and decreases as component (b) is consumed by the reaction. When the alcohol is added, the decpmposition of component (b) is accelerated. Hence, the oxidation-reduction potential decreases as the amount of the alcohol added is increased. The oxidation-reduction potential can, therefore, be controlled by increasing or decreasing the rate of addition of component (b) and/or the alcohol.

Figure 2:
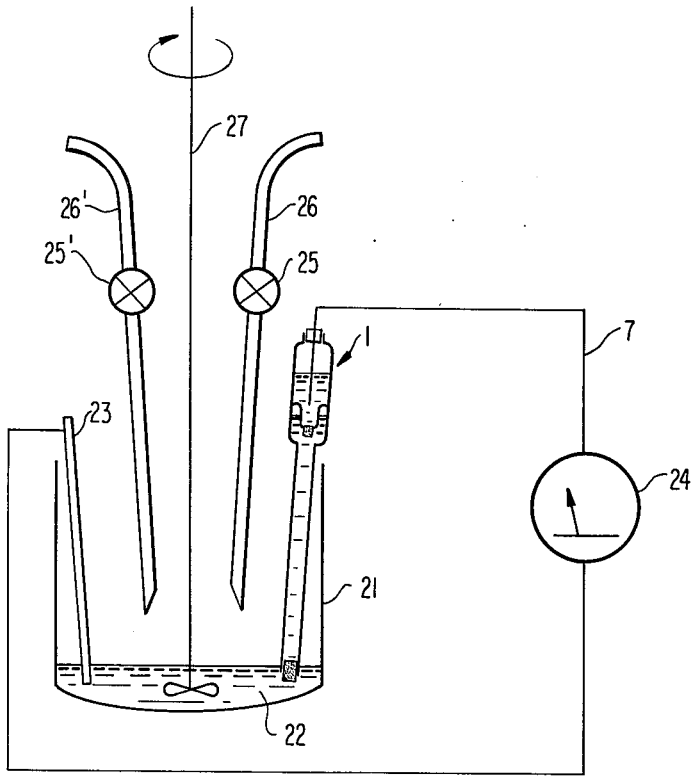
FIG. 2 is a diagram of an apparatus for use in the performance of the process of this invention.

Various known techniques may be used to increase or decrease the rate of addition. For example, as shown in FIG. 2, the rate of addition of Liquid (II) or a reaction promotor added to a reactor 21 through a feed pipe 26 or 26' can be adjusted by a flow rate adjusting device 25 or 25' (for example, a pump or a valve capable of controlling the rate of rotation, an orifice, or a gas-pressurizing device).

The oxidation-reduction potential of the reaction solution is controlled according to a predetermined pattern.

The control of the oxidation-reduction potential of the reaction solution according to a predetermined pattern means that the oxidation-reduction potential of the reaction solution is varied according to certain values of the oxidation-reduction potential of the reaction solution which can be pre-set for the entire period of the reaction ranging from the initiation of the reaction [the time the mixing of components (a) and (b) is initiated] to the end of the mixing [the time the mixing of components (a) and (b) is ended]. This includes maintaining the potential at a constant value from the initiation of to the end of the mixing, and varying the potential during the mixing. However, to obtain a silver halide having a narrow grain size distribution, the oxidation-reduction potential of the reaction solution should preferably be controlled such that the potential will not fall outside a certain predetermined range from the beginning of addition of component (b) to component (a) to the end of addition. This certain predetermined range varies depending on the types of components (a) and (b) and the construction of the reference electrode, and cannot be set forth unequivocally. Generally, when the reference electrode described in Example 1 is used, this predetermined range is set at +200 mV to −50 mV, especially +150 mV to −20 mV, these oxidation-reduction potential values being those when the potential of an isopropanol solution containing $10^{-3}$ mol/l of $AgClO_4$ at 20° to 25° C. measured using a silver electrode and the reference electrode is considered to be 0 mV.

Further, after the mixing of components (a) and (b) has been completed, the oxidation-reduction potential of the reaction solution gradually decreases as component (b) is decomposed. Accordingly, by monitoring the decrease in the oxidation-reduction potential, it is possible to detect the end point at which component (b) has been sufficiently decomposed. In other words, the point when the decrease of the oxidation-reduction potential stops is the point when component (b) has been sufficiently decomposed. However, in many cases, the point when the oxidation-reduction potential of the reaction solution measured using a reference electrode as described in Example 1 described hereinbelow becomes 0 mV or less, in particular −20 mV or less, can be considered to be the end point of the decomposition of component (b). This is because even when the reaction operation is stopped at this point, no substantial reduction in the light-sensitivity of the thermally developable light-sensitive material nor reduction in contrast occurs.

The values of the oxidation-reduction potential set forth above are those when the characteristic value of the reference electrode prepared in the manner described in Example 1 described hereinbelow is 0 mV. Even using a reference electrode prepared in the same manner as that in Example 1, for various reasons the same measuring results are not always obtained. Accordingly, it is necessary to preliminarily measure the characteristic value of the reference electrode used and to correct the characteristic value with the potential of the reference electrode measured in the actual halidizing reaction thereby determining the oxidation-reduction potential of the reaction solution. This characteristic value is determined by the potential obtained by measuring the potential of an isopropanol solution of $AgClO_4$ having a concentration of $10^{-3}$ mol/l at 20° to 25° C. using a Ag electrode and the reference electrode.

To achieve a control of the oxidation-reduction potential of the reaction solution, the oxidation-reduction potential needs to be measured. An inert electrode is used as a measuring electrode, and a preferred example of such an inert electrode is a platinum electrode. On the other hand, various electrodes can be used as a reference electrode. When a calomel electrode or a silver-silver chloride electrode containing a halogen ion in the internal liquid is used as the reference electrode, the halogen ion in the internal liquid reacts with silver ion in the reaction solution, and this reduces the accuracy of the measurement of the oxidation-reduction potential.

It is preferred therefore to use a reference electrode which does not contain a halogen ion in the internal liquid thereof.

When the solvent of the reaction solution containing the organic silver salt (a) and the halogen atom-releasing compound (b) is an organic solvent, the use of a calomel electrode or a silver-silver chloride electrode containing water as the solvent of the internal liquid results in a variation in the potential between the reaction solution and the reference electrode, and thus a reduction in the accuracy of measurement of the oxidation potential. It is preferred, therefore, for the composition of the solvent in the internal liquid of the reference electrode to be identical with the composition of the solvent in the reaction solution; or for the solvent as a main ingredient of the reaction solution to be used as the internal liquid of the reference electrode; or for a solvent having a dielectric constant approximating that of the solvent of the reaction solution to be used as the internal liquid of the reference electrode.

Preferred reference electrodes for use in this invention may be of the single junction type or of the double junction type. A double junction type reference electrode shown in FIG. 1 is especially effective for continuous measurement of the potential over long periods of time since the internal liquid of the electrode is contaminated less by the reaction solution.

In FIG. 1, reference electrode 1 is separated into internal solution-support tube 11 and external solution-support tube 12, in which internal solution 2 and external solution 2', respectively, as illustrated, are retained. The electrode may be filled with solutions through replenishing inlets 6 and 6' provided at the side of each of the tubes. Ground glass or Teflon stoppers can be advantageously used as stoppers for replenishing inlets 6 and 6', since they are not damaged by internal solution 2 or external solution 2', as compared with rubber stoppers or the like. Internal electrode 3 is immersed in internal solution 2. Internal solution 2 and external solution 2' are connected to each other via connector 4 made of a material which does not prevent migration of ions therebetween. It is also possible to connect these two solutions using pinholes in the internal solution-support tube. At the bottom of external solution-support tube 12 which is immersed into the reaction solution to measure the potential is provided bottom connector 5 made of a material which does not prevent migration of ions between the external solution 2' and the solution to be measured. Advantageous materials for connector 4 and bottom connector 5 are ceramic chips and glass frit.

The external solution 2' described above having the same composition as the composition of internal solution 2 except for the "metal salt of the metal of the internal electrode" as described below is preferred.

Metals, preferably metals which are difficultly oxidized, particularly preferably metals having a lower ionization tendency than that of hydrogen, can be used as the internal electrode described above. In some cases, metals whose surfaces have been converted to the oxide or the sulfide thereof can be used. In the present invention, silver, palladium, gold or platinum can be used as the internal electrode, with silver, silver sulfide or silver oxide being preferred as the internal electrode. Of these, silver is particularly preferred. The form of the electrode is not particularly limited, and the electrode may be in the form of, for example, rods, plates, wires, etc.

A soluble metal salt of the metal of the internal electrode is incorporated in the internal solution of the reference electrode to be used in the present invention. For example, where silver, silver sulfide or silver oxide is used as an internal electrode, silver salts soluble in the solvent of the internal solution are used. The above-described metal salts must be soluble to some extent in the solvent of the internal solution and ionize to form metal ions. Since the concentration of the metal ion does not necessarily need to be very high, the solubility of the metal salt in the solvent of the internal solution may be low. For example, a solubility of $10^{-6}$ mol/l or more is sufficient. Therefore, the most important factor in selecting suitable metal salts is to select those which do not release halide ions when they are dissolved in the solvent of the internal solution. More specifically, illustrative examples include nitrates, perchlorates, acetates, sulfates, etc. Of these, nitrates and perchlorates are preferably used. Perchlorates are particularly preferred where an organic solvent is used as the reaction medium because of the high solubility of perchlorates in organic solvents. Further, where silver, silver sulfide or silver oxide is used as an internal electrode, silver nitrate or silver perchlorate is preferably used, and silver perchlorate is most preferred.

The mixing proportion of the metal salt of the metal of the internal electrode with the solvent of the internal solution may be varied as desired. However, in general, the mixing proportion of the metal salt ranges from about $10^{-5}$ to about 1 mol/l, preferably from about $10^{-4}$ to about $10^{-1}$ mol/l.

An electrolyte is also added to the above-described internal solution, since the presence of the electrolyte improves the accuracy in measuring the electrode potential and improves the stability. Those electrolytes which are soluble in the solvent of the internal solution, preferably with a solubility of $10^{-3}$ mol/l or more, can be used. On the other hand, electrolytes which can be used must not release halide ions when dissolved in the solvent of the internal solution. Specific examples of electrolytes which can be used include salts of metals having a higher ionization tendency than that of hydrogen (for example, salts of K, Na, Li, Mg, Ca, Rb, Cs, Sr, etc.), onium salts (for example, ammonium, tetra-n-propylammonium, tetraethylammonium, etc., salts), and, in particular, the nitrates or perchlorates thereof. Of these, sodium nitrate, potassium nitrate, calcium nitrate, lithium nitrate, etc., are preferred. In particular, calcium nitrate is useful since it has a good solubility in organic liquids.

The amount of electrolyte which can be used ranges from about $10^{-1}$ to about $10^{-4}$ mols, preferably from 0.2 mol to $10^{3}$ mols, per mol of the metal salt of the metal of the internal electrode. The concentration of the electrolyte in the solvent of the internal solution may be varied as desired, but, in general, a suitable concentration ranges from about $10^{-6}$ to about $10^{4}$ mol/l, preferably from about $2\times10^{-5}$ to about $10^{2}$ mol/l. Therefore, the metal salt of the metal of the internal electrode and the electrolyte added to the internal solution may partly be precipitated, although a concentration of a saturate solution or less is preferably used.

The oxidation-reduction potential can be measured in the following manner. As shown in FIG. 2, a reference electrode 1 and a measuring electrode 23 such as a platinum electrode are immersed in reaction solution 22 stirred with a stirrer 27 within a reactor 21, and the two electrodes are connected by a lead wire 7 via a potentiometer 24. The oxidation-reduction potential of the reaction solution is indicated by the potentiometer.

A mixture of the organic silver salt and a silver halide having a narrow grain size distribution can be obtained by controlling the measured oxidation-reduction potential of the reaction solution within the range described above.

The temperature for the reaction between components (a) and (b) can be varied over a wide range. When a reaction promotor is not present in the reaction system, the reaction solution must be heated. The reaction solution can be heated to a temperature of at least 30° C., preferably at least 40° C. When a reaction promoter is used, heating is not particularly required, and the reaction proceeds even at about 0° C. Usually, it is preferred to maintain the reaction solution at room temperature to 30° C. or higher. The heating temperature can range up to the boiling point of the reaction solvent used in either case.

Since variation of the oxidation-reduction potential of the solution in the reaction between components (a) and (b) upon temperature is low, changes in temperature of the reaction do not adversely affect the ability to control the reaction by the oxidation-reduction potential of the reaction solution within the range set forth herein.

The reaction pressure can be varied over a wide range, but usually the reaction is carried out at atmospheric pressure or pressure near atmospheric pressure.

Addition of a polymer to the reaction solution, especially Liquid (I), is preferred since the presence of a polymer improves the dispersibility of the organic silver salt (a) and uniformly induces the reaction between components (a) and (b). Examples of polymers that can be used for this purpose are the synthetic polymers described in Japanese Patent Application (OPI) No. 9432/72, preferably polyvinyl acetalls such as polyvinyl butyral, and vinyl copolymers containing a recurring unit having a thioether moiety and a recurring unit of an alkyl acrylate. Polyvinyl acetate, polyvinyl propionate, poly(methyl methacrylate) and cellulose acetate butyrate can also be used although they are not as preferred as the preferred polymer species exemplified above. The amount of the polymer can be varied widely, but is preferably about 0.01 g to about 100 g, especially about 0.03 g to about 50 g, per gram of the organic silver salt (a).

The reaction solution in accordance with this invention may contain impurity polyvalent metal ions so as to produce a silver halide having a high internal sensitivity. Preferred impurity metal ions are divalent, trivalent or tetravalent metal ions. Specific examples of such metal ions include lead, cadmium, tin, iron, bismuth, osmium, rhodium, palladium, copper, nickel, cobalt, gold, iridium, and cerium ions. A suitable material such as a halogen ion may be coordinated with such a metal ion. The amount of the impruity metal ion can be varied over a wide range, but generally, it is within the range of $^{-8}$ to $10^{-2}$ per mole of the silver halide to be formed.

Since the amount of the polyvalent metal ions present is small, they do not substantially alter the oxidation-reduction potential to cause problems relative to control thereof.

The reaction between components (a) and (b) is preferably carried out with strirring. The stirring conditions will vary depending, for example, on the capacity and shape of the reactor, and the shape of the stirrer vanes. The stirring speed preferably is about 50 rpm to about 10,000 rpm.

To complete the reaction between components (a) and (b), the mixture of components (a) and (b), after mixing, preferably is allowed to stand for a suitable period of time (preferably 1 minute to 48 hours) with stirring at 0° C. to the boiling point of the reaction solvent. Completion of the reaction can be evaluated by the time at which the decrease of the oxidation-reduction potential of the reaction solution ceases. Alternatively the completion of the reaction can be evaluated by the time at which decoloration of a merocyanine dye ceases, as disclosed in Japanese Patent Application (OPI) No. 115027/75.

The silver halide prepared by the method of this invention may be chemically sensitized using known chemical sensitizing methods disclosed, for example, in Japanese Patent Application (OPI) No. 115027/75. Alternatively the silver halide can be sensitized with a sensitizing dye described, for example, in Japanese Patent Application (OPI) No. 36020/77.

The method described hereinabove can be used to produce a mixture of the organic silver salt and a silver halide which has a uniform grain size and which is in close contact with the surface of the organic silver salt.

The mixture of the organic silver salt and the silver halide prepared by the method of this invention may also be used in conjunction with silver halides prepared using various known methods. For example, a silver halide prepared by preparing the above described organic silver salt in the presence of a photosensitive silver halide-forming agent (to be described hereinbelow) may be used in combination. A method for preparing the silver halide to be used in combination is described, for example, in British Pat. No. 1,447,454.

Another more preferred method for forming the silver halide to be used together with the silver halide in accordance with this invention comprises reacting a silver halide-forming agent (to be described hereinbelow) with a separately prepared organic silver salt to convert a part of the organic silver salt to silver halide. This method is described, for example, in Japanese Patent Publication No. 4924/68 and British Pat. No. 1,498,956.

Another method for forming the photosensitive silver halide which can be used in conjunction with the silver halide in accordance with this invention involves preparing a silver halide separately, and mixing the silver halide with the organic silver salt. This method is described, for example, in Japanese Patent Publication No. 82852/73, U.S. Pat. No. 4,076,539, Japanese Patent Application (OPI) No. 9432/72, Belgian Pat. No. 774,436, French Pat. Nos. 2,107,162 and 2,078,586 and U.S. Pat. No. 3,706,564.

When a silver halide is to be copresent as described above, the method of this invention is preferably performed after having the organic silver salt and a silver halide to be used together therewith which has been prepared by another method outside the scope of the present invention.

In this case, at least 50 mole% of the total halogen preferably is derived from the halogen atom-releasing compound (that is, at least 50 mole% of the total silver halide preferably is prepared by the method of this invention). It is particularly preferred for at least 80 mole% of the total halogen to be a halogen derived from an N-halo or C-halo compound as used in the method of this invention, i.e., for at least 80 mole% of the total silver halide to be prepared using the method of this invention.

Examples of silver halide-forming agents which can be used are metal halides, halogen-containing metal complex onium halides and hydrogen halides described in Japanese Patent Application (OPI) No. 36020/77. N-halo or C-halo compounds as described hereinbefore can, of course, also be used to prepare silver halide without controlling the oxidation-reduction potential as in this invention. However, as set forth above, at least 50 mole% of the halogen derived from the N-halo or C-halo compound and obtained using the method of this invention, i.e., while controlling the oxidation-reduction potential, is preferred.

The composition for a thermally developable light-sensitive material is prepared in the second embodiment of this invention by adding a reducing agent (c) to the thus-prepared mixture of the organic silver salt and silver halide. The reducing agent (c) is a compound capable of reducing the organic silver salt (a) when heated in the presence of the exposed silver halide. The reducing agent to be used is selected depending upon the type or poperties of the organic silver salt (a).

Suitable reducing agents which can be used include, for example, monophenols, polyphenols such as bis-, tris- or tetrakis-phenols, mono- or bis-naphthols, di- or poly-hydroxynaphthalenes, di- or poly-hydroxybenzenes, hydroxy monoethers, ascorbic acids, 3-pyrazolidones, pyrazolines, pyrazolones, reducing sugars, phenylenediamines, hydroxylamines, reductones, hydroxamic acids, hydrazides, amideoximes and N-hydroxyureas. Specific examples of these compounds are described in detail in U.S. Pat. Nos. 3.615,533, 3,679,426, 3,672,904, 3,667,958, 3,751,255, 3,801,321, and 3,928,686, West German Patent Applications (OLS) Nos. 2,020,939, 2,031,748, 2,319,080 and 2,321,328, and Japanese Patent Application (OPI) Nos. 115540/74, 36110/75, 116023/75, 147711/75, 23721/76, 51933/76, and 36020/77.

A suitable reducing agent is selected depending upon the type (or properties) of the organic silver salt (a). For example, stronger reducing agents are suitable for silver salts which are relatively difficult to reduce, such as a silver salt of benzotriazole or silver behenate, and weaker reducing agents are suitable for silver salts which are relatively easy to reduce, such as silver caprate or silver laurate.

The simplest method for those skilled in the art to select a reducing agent is to prepare a light-sensitive material such as shown in Examples, and examine the suitability of the reducing agent based on the photographic characteristics of the light-sensitive material.

When fatty acid silver salts are used as the organic silver salt, polyphenols having an alkyl group such as a methyl group, an ethyl group, a propyl group, a butyl group or an amyl group, a cycloalkyl group such as a cyclohexyl group, or an acyl group such as an acetyl group or a propionyl group at at least one of the two positions adjacent the hydroxyl-substituted position of the aromatic ring, for example, mono-, bis-, tris- or tetrakis-phenols with a 2,6-di-t-butyl-phenyl group are especially preferred because they are less susceptible to discoloration under light.

Specific examples of preferred reducing agents are orthopolyphenols such as 1,1-bis(2-hydroxy-3,5-dimethylphenyl-3,5,5-trimethylhexane, 1,1-bis(2-hydroxy-3-t-butyl-5-methylphenyl)-methane, 1,1-bis(2-hydroxy-3,5-di-t-butylphenyl)methane, 2,6-methylenebis(2-hydroxy-3-t-butyl-5-methylphenyl)-4-methylphenol, 6,6-benzylidene-bis(2,4-di-t-butylphenol), 6,6'-benzylidene-bis(2-t-butyl-4-methylphenol), 6,6'-benzylidene-bis(2,4-dimethylphenol), 1,1-bis(2-hydroxy-3,5-dimethylphenyl)-2-methylpropane and 1,1,5,5-tetrakis-(2-hydroxy-3,5-dimethylphenyl)-2,4-ethylpentane; and bisphenols such as 2,2-bis(4-hydroxy-3,5-dimethylphenyl)propane, 2,2-bis(4-hydroxy-3-methyl-5-t-butylphenyl)propane and 2,2-bis(4-hydroxy-3,5-di-t-butylphenyl)propane.

The amount of the reducing agent used in this invention varies depending on the type of the organic silver salt or the reducing agent, or other additives present. Generally, the amount of the reducing agent is about 0.05 mole to about 10 moles, preferably about 0.1 to about 3 moles, per mole of the organic silver salt. The reducing agents exemplified hereinabove may be used individually or as mixtures thereof.

In this embodiment, the reducing agent is added to the mixture of the organic salt (a) and the silver halide (b) prepared by the method described hereinabove. In many cases, the reducing agent is a solid, and may be added to the mixture as such. Preferably, the reducing agent is added as a dispersion or solution in an organic solvent of the types exemplified hereinabove. Alternatively, a layer of the mixture containing components (a) and (b) is formed on a support, and a solution containing the reducing agent is coated on top of this layer, thus effecting the mixing of the mixture of (a) and (b) with the reducing agent (c).

The composition for a thermally developable light-sensitive material in accordance with this embodiment of this invention can be prepared in this manner.

In addition to the above components, the composition of this invention may contain various additives known in the art of thermally developable light-sensitive materials, such as toning agents, light discoloration inhibitors and heat fog inhibitors. For example, the phthalazinones or cyclic imide compounds disclosed in Japanese Patent Application (OPI) No. 36020/77 can be used as toning agents. When a toning agent is used, a suitable amount is about 0.0001 mole to about 2 moles, preferably about 0.0005 mole to about 1 mole, per mole of the organic silver salt (a). The compounds described in Japanese Patent Application (OPI) No. 36020/77 can be used as light discoloration inhibitors and heat fog inhibitors.

At least one colloid used as a binder is preferably added to the composition of this invention. Suitable binders are generally hydrophobic in many cases, but hydrophilic binders may also be used. These binders are transparent or semitransparent, and suitable binders are colorless, white or light-colored. Examples of binders include proteins such as gelatin, cellulose derivatives, polysaccharides such as dextran, natural substances such as gum arabic, and synthetic polymers. Suitable binders are described in Japanese Patent Application (OPI) Nos. 22431/76, 126408/75, 29126/76, 19525/76, and 84443/74. Especially preferred binders are, for example, polyvinyl butyral, polyvinyl acetate, ethyl cellulose, vinylidene chloride, vinyl chloride copolymers, polymethyl methacrylate, vinyl chloride/vinyl acetate copolymers, cellulose acetate butyrate, gelatin, and polyvinyl alcohol. If desired, two or more binders may be used as a mixture. The weight ratio of the binder to the organic silver salt (a) is about 10:1 to about 1:10, preferably about 4:1 to about 1:4.

A thermally developable light-sensitive material can be prepared by using the composition of this invention. This can be achieved by coating the composition of this invention on a support, which can be selected from a wide range of materials.

The coating can be achieved using known coating methods such as air knife coating, curtain coating or hopper coating. The support may be of any shape, but is preferably flexible for ease of handling as an information recording material. Usually, the shape is that of a film, a sheet, a roll or a ribbon. The support may be made of a material such as a synthetic resin film or sheet, glass, wool, cotton cloth, paper, and metals such as aluminum.

The thermally developable light-sensitive material so produced may include other auxiliary layers suitable for particular purposes, such as a vacuum-deposited metal layer, a backing layer, a top polymer layer or an antihalation layer. Such auxiliary layers can be provided by using the materials and methods described in Japanese Patent Application (OPI) Nos. 43130/76, 13609/75 and 36020/77, U.S. Pat. No. 3,748,137 and British Pat. No. 1,261,102.

An image can be obtained by imagewise exposing the thermally developable light-sensitive material, and then simply heating the material.

For the first time, the method of this invention has made it possible to control the grain size distribution of the silver halide prepared by the halidizing method, especially the halidizing method in which a halogen atom-releasing compound (not a halogen ion) is used as a halogen releasing agent. The silver halide prepared in accordance with this invention by performing halidizing at a controlled oxidation-reduction potential has a narrow grain size distribution, and is suitable for preparation of a composition for a thermally developable light-sensitive material having a large $\gamma$ value. Furthermore, since the method of this invention can be used to produce a silver halide having a large particle size, a composition for a thermally developable light-sensitive material having a high sensitivity can be prepared. Silver halide having a narrow grain size distribution is preferred for dye sensitization, and the process of this invention can be used to produce a composition for a thermally developable light-sensitive material having superior dye sen' itizability. Accordingly, the composition prepared by the process of this invention makes it possible to produce a thermally developable light-sensitive materials having superior properties.

The method of this invention also makes it possible to detect with accuracy and in a simple and quantitative manner the point when component (b) has been sufficiently decomposed by measuring the oxidation-reduction potential of the reaction solution, and is very useful in managing the steps of the halidizing reaction.

Further, in particular, the method of this invention permits the production of a composition for a thermally developable light-sensitive material on a large scale in an inexpensive and smooth manner.

The following Examples are given to illustrate the present invention in more detail. Unless otherwise indicated herein, all parts, percents, ratios and the like are by weight.

EXAMPLE 1

Preparation of Silver Behenate

Silver behenate (as a polymer dispersion) was prepared in the following manner.

Behenic acid (34 g) was mixed with 500 ml of water, and the mixture was heated to 85° C. to melt the behenic acid. The mixture of water and behenic acid melted at 85° C. was stirred at 1800 rpm, and an aqueous solution of sodium hydroxide (2.0 g of sodium hydroxide+50 cc of water) (25° C.) was added over the course of 3 minutes to form a mixture of sodium behenate and behenic acid. With stirring at 1800 rpm, the temperature of the mixture was decreased from 85° C. to 30° C.

With continued stirring, an aqueous solution of silver nitrate (8.5 g of silver nitrate+50 cc of water) (25° C.) was added over the course of 3 minutes, and the mixture was stirred for 90 minutes. Isoamyl acetate (200 cc) was added thereto, and the resulting silver behenate particles were recovered. They were dispersed in an isopropanol solution of polyvinyl butyral (25 g of polyvinyl butyral+200 cc of isopropanol) using a homogenizer at 25° C. and 3000 rpm for 30 minutes to produce a polymer dispersion of silver behenate [Liquid (I)].

Preparation of Reference Electrode

A reference electrode of the type shown in FIG. 1 was produced by using a silver rod as an internal electrode, ceramic chips as a connecting chip and a bottom chip, an ethanol solution containing $10^{-2}$ mole/liter of $AgClO_4$ and $10^{-1}$ mole/liter of $Ca(NO_3)_2$ as an internal liquid and an ethanol solution containing $10^{-1}$ mole/liter of $CA(NO_3)_2$ as an external liquid.

Next, the characteristic value of the reference electrode was measured in the following manner. A Ag electrode and the reference electrode were inserted in an isopropanol solution of silver perchlorate of a concentration of $10^{-3}$ mol/l. The potential measured using a potentiometer (HM-18B, a product of Toa Denpa Kabushiki Kaisha) was found to be 0 mV. Thus, the characteristic value of the reference electrode was confirmed to be 0 mV.

The reference electrode was connected to a measuring platinum electrode as a measuring electrode through a potentiometer (HM-18B) as shown in FIG. 2. The electrodes were immersed in the polymer dispersion of silver behenate placed in a reaction vessel.

Halidizing at Controlled Oxidation-Reduction Potential

The polymer dispersion of silver behenate in the reactor was heated at 50° C. with stirring at 500 rpm, and maintained at this temperature.

Separately, 100 ml of a 1.4 wt.% acetone solution of N-bromosuccinimide [Liquid (II)] was prepared, and the suction opening of a roller pump (RP-$V_1$, a product of Furue Science Kabushiki Kaisha) was set in this solution. The discharge opening of the roller pump was placed in the inside of the reaction vessel.

By operating the roller pump, Liquid (II) was fed into the reaction vessel. The rotating speed of the roller pump was adjusted so that the oxidation-reduction potential of the reaction solution would be maintained at +50 mV until the end of addition of Liquid (II), thus increasing or reducing the speed of addition of Liquid (II). After adding 100 ml of Liquid (II) in this way, the temperature of the reaction solution was maintained at 50° C. and allowed to stand for 30 minutes. The oxidation-reduction potential of the reaction solution was −45 mV. The reaction operation was stopped at this time.

The grain size of the silver bromide contained in the resulting mixture of silver behenate and silver bromide was examined with an electron microscope. It was found that about 90% of the silver bromide grains had a size within the range of $0.08\mu \pm 0.01\mu$. It was thus confirmed that monodispersed silver bromide grains were obtained.

COMPARATIVE EXAMPLE 1

Silver bromide grains were prepared using the same method as described in Example 1 except that the oxidation-reduction potential of the reaction solution was not controlled and 100 ml of Liquid (II) was added over the course of 60 minutes.

The grain size of silver bromide contained in the resulting mixture of silver behenate and silver bromide was examined with an electron microscope. It was found that about 90% of the silver bromide grains had a size of $0.02\mu$ to $0.12\mu$, and the grain size distribution was very broad.

EXAMPLE 2

A mixture of silver behenate and silver bromide was prepared in the same manner as described in Example 1 except that 100 ml of a 1 wt.% acetone solution of 1,4-di(bromomethyl)-benzene [Liquid (II')] was used instead of the N-bromosuccinimide, the temperature was changed to 60° C., and Liquid (II') was added so that the oxidation-reduction potential of the reaction solution would be maintained at +100 mV. The reaction operation was stopped at the point in time when after the addition of the 1,4-di(bromomethyl)benzene solution, the oxidation-reduction potential of the reaction solution became −28 mV.

It was found that about 90% of the silver bromide grains had a grain size within the range of $0.1\mu \pm 0.02\mu$, and monodispersed silver bromide grains were obtained.

COMPARATIVE EXAMPLE 2

A mixture of silver behenate and silver bromide was prepared in the same manner as described in Example 2 except that the oxidation-reduction potential of the reaction solution was not controlled, and Liquid (II') was added over the course of 60 minutes.

It was found that about 90% of the silver bromide grains had a grain size within the range of 0.04 to $0.15\mu$, and therefore they had a very broad grain size distribution.

EXAMPLE 3

A mixture of silver behenate and silver bromide was prepared in the same manner as described in Example 2 except that a 1.1 wt.% acetone solution of N-bromoacetamide [liquid (II'')] was added instead of Liquid (II'). The end point of the reaction operation was determined at the time when the oxidation-reduction potential of the reaction solution became −25 mV.

It was found that about 90% of the silver bromide grains had a grain size within the range of 0.1 $\mu \pm 0.013\mu$, and monodispersed silver bromide grains were obtained.

COMPARATIVE EXAMPLE 3

A mixture of silver behenate and silver bromide was prepared in the same manner as described in Example 3 except that the oxidation-reduction potential of the reaction solution was not controlled, and Liquid (II″) was added over the course of 60 minutes.

It was found that about 90% of the silver bromide grains had a grain size within the range of $0.05\mu$ to $0.14\mu$, and the grain size distribution was very broad.

EXAMPLE 4

About 1/240 mole (silver behenate and silver bromide) of each of the polymer dispersions of silver bromide and silver behenate prepared in Example 1 and Comparative Example 1 was taken, and maintained at 30° C. With stirring at 200 rpm, the following ingredients were added at 5 minute intervals to prepare coating solutions (A) and (B).

| | | |
|---|---|---|
| (i) | Merocyanine Dye (sensitizing dye)* (0.025 wt. % methyl Cellosolve solution) | 2 ml |
| (ii) | Sodium Benzenethiosulfonate (0.01 wt. % methanol solution) | 2 ml |
| (iii) | m-Nitrobenzoic Acid (0.5 wt. % ethanol solution) | 2 ml |
| (iv) | Phthalazinone (4.5 wt. % methyl Cellosolve solution) | 5 ml |
| (v) | o-Bisphenol (reducing agent)** (10% by weight acetone solution) | 10 ml |

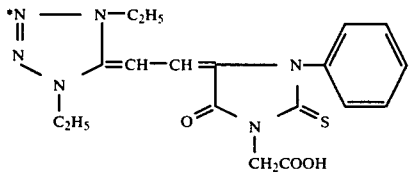

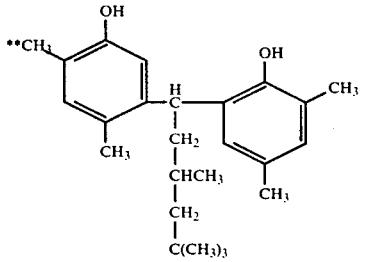

Coating solution (A) and (B) were each coated on a support paper so that the amount of silver per $m^2$ would be about 0.3 g. Thus, thermally developable Light-Sensitive Materials (A) and (B) were produced.

Each of the thermally developable Light-Sensitive Materials (A) and (B) so prepared was exposed through an optical wedge to light from a tungsten lamp (with the maximum amount of exposure being 3000 CMS), and then heated by contacting the materials with a hot plate at 130° C. for 8 seconds. The $\gamma$ values of the resulting images were measured, and the results obtained are tabulated below.

| Sample | Silver Bromide-Silver Behenate Dispersion | $\gamma$ Value |
|---|---|---|
| (A) | Example 1 | 3.8 |
| (B) | Comparative Example 1 | 2.1 |

Sample (A) evidently showed a higher $\gamma$ value.

While the invention has been described in detail and with reference to specific embodiments thereof, it will be apparent to one skilled in the art that various changes and modifications can be made therein without departing from the spirit and scope thereof.

What is claimed is:

1. In a process for preparing a composition for use in a thermally developable light-sensitive material, which comprises reacting (a) an organic silver salt with (b) a compound capable of releasing a halogen atom or a radical containing halogen by mixing a dispersion of component (a) and a dispersion or solution of component (b) to form a reaction solution mixture of the organic silver salt and a silver halide wherein the improvement the reaction of component (a) with component (b) is carried out while controlling the oxidation-reduction potential of the reaction solution, such that the potential does not fall outside a certain pre-determined range from the beginning of addition of component (b) to component (a) to the end of the said addition, whereby silver halide grains of a controlled grain size and a narrow grain size distribution are obtained due to the control of the oxidation-reduction potential.

2. The process of claim 1, wherein the organic silver salt (a) is a silver salt of an organic compound containing an imino group, a mercapto group, a thione group or a carboxyl group.

3. The process of claim 2, wherein the silver salt (a) is a silver salt of a straight-chain fatty acid containing at least 12 carbon atoms.

4. The process of claim 1, wherein the halogen atom-releasing compound (b) is selected from the group consisting of N-halo compounds of the formula (I)

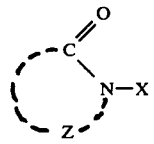

(I)

wherein X represents Cl, Br or I, and Z represents the atoms necessary to form a 4- to 8-membered ring, N-halo compounds of the formula (II)

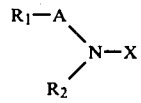

(II)

wherein X is as defined above; A represents a carbonyl group or a sulfonyl group; and $R_1$ and $R_2$, which may be the same or different, each represents a hydrogen atom, an alkyl group, an aryl group or an alkoxy group, and C-halo compounds of the formula (IV)

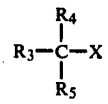

(IV)

wherein X is as defined above; $R_3$, $R_4$ and $R_5$, which may be the same or different, each represents a hydrogen atom, an alkyl group containing 1 to 10 carbon atoms, an aryl group containing 6 to 14 carbon atoms, a nitro group, an acyl group of the formula $R_6$—CO in which $R_6$ represents an alkyl group containing 1 to 10 carbon atoms or an aryl group containing 6 to 14 carbon atoms, an amido group of the formula

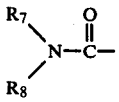

in which $R_7$ and $R_8$, which may be the same or different, each represents a hydrogen atom, an alkyl group containing 1 to 10 carbon atoms or an aryl group containing 6 to 14 carbon atoms, a sulfonyl group of the formula $R_8$—$SO_2$—in which $R_9$ represents an alkyl group containing 1 to 10 carbon atoms or an aryl group containing 6 to 14 carbon atoms; and at least one of $R_3$, $R_4$ and $R_5$ is a group which promotes the release of a halogen atom.

5. The process of claim 1, 2, 3 or 4, wherein the amount of component (b) is about 0.005 to about 0.5 mole per mole of component (a).

6. The process of claim 1, 2, 3 or 4, wherein the reaction of components (a) and (b) is performed in the presence of a reaction promoter.

7. The process of claim 6, wherein the reaction promoter is a primary or secondary alcohol.

8. The process of claim 6, wherein the amount of the reaction promoter is at least 1 mole per mole of component (b).

9. The process of claim 1, wherein the oxidation-reduction potential of the reaction solution is controlled by increasing or decreasing the rate of adding component (b) to the reaction solution.

10. The process of claim 6, wherein the oxidation-reduction potential of the reaction solution is controlled by increasing or decreasing the rates of adding component (b) and the reaction promoter to the reaction solution.

11. The process of claim 1, wherein the process additionally includes adding (c) a reducing agent to the mixture of the organic silver salt and the silver halide.

12. The process of claim 11, wherein the organic silver salt (a) is a silver salt of an organic compound containing an imino group, a mercapto group, a thione group or a carboxyl group.

13. The process of claim 12, wherein the silver salt (a) is a silver salt of a straight-chain fatty acid containing at least 12 carbon atoms.

14. The process of claim 11, wherein the halogen atom-releasing compound (b) is selected from the group consisting of N-halo compounds of the formula (I)

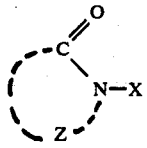

(I)

wherein X represents Cl, Br or I, and Z represents the atoms necessary to form a 4- to 8-membered ring, N-halo compounds of the formula (II)

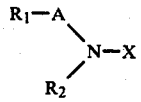

(II)

wherein X is as defined above; A represents a carbonyl group or a sulfonyl group; and $R_1$ and $R_2$, which may be the same or different, each represents a hydrogen atom, an alkyl group, an aryl group or an alkoxy group, and C-halo compounds of the formula (IV)

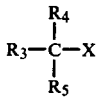

(IV)

wherein X is as defined above; $R_3$, $R_4$ and $R_5$, which may be the same or different, each represents a hydrogen atom, an alkyl group containing 1 to 10 carbon atoms, an aryl group containing 6 to 14 carbon atoms, a nitro group, an acyl group of the formula $R_6$—CO—in which $R_6$ represents an alkyl group containing 1 to 10 carbon atoms or an aryl group containing 6 to 14 carbon atoms, an amido group of the formula

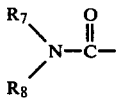

in which $R_7$ and $R_8$, which may be the same or different, each represents a hydrogen atom, an alkyl group containing 1 to 10 carbon atoms or an aryl group containing 6 to 14 carbon atoms, a sulfonyl group of the formula $R_9$—$SO_2$—in which $R_9$ represents an alkyl group containing 1 to 10 carbon atoms or an aryl group containing 6 to 14 carbon atoms; and at least one of $R_3$, $R_4$ and $R_5$ is a group which promotes the release of a halogen atom.

15. The process of claim 11, 12, 13 or 14, wherein the amount of component (b) is about 0.005 to about 0.5 mole per mole of component (a).

16. The process of claim 11, 12, 13 or 14, wherein the reaction of components (a) and (b) is performed in the presence of a reaction promoter.

17. The process of claim 16, wherein the reaction promoter is a primary or secondary alcohol.

18. The process of claim 16, wherein the amount of the reaction promoter is at least 1 mole per mole of component (b).

19. The process of claim 11, wherein the oxidation-reduction potential of the reaction solution is controlled by increasing or decreasing the rate of adding component (b) to the reaction solution.

20. The process of claim 16, wherein the oxidation-reduction potential of the reaction solution is controlled by increasing or decreasing the rates of adding component (b) and the reaction promoter to the reaction solution.

21. The process of claim 1, wherein said reaction solution comprises an organic solvent reaction solution.

22. The process of claim 1, wherein the oxidation-reduction potential is measured using, as the measuring electrode, a platinum electrode, and using, as the reference electrode, an electrode which does not contain halogen ion in the internal liquid thereof, wherein the process is carried out in a reaction solvent, the internal liquid being selected from the group consisting of the solvent in the reaction solution, or if more than one solvent is used in the reaction solution, the main solvent, or the internal liquid having a dielectric constant approximating that of the solvent for the reaction solution.

23. The process of claim 22, wherein the reference electrode comprises a metal internal electrode immersed in an internal liquid, said internal liquid comprising a soluble metal salt of the metal forming said internal electrode and an electrolyte.

24. The process of claim 23, wherein said internal electrode comprises silver.

25. The process of claim 23, wherein said metal salt is a nitrate, perchlorate, acetate or sulfate of the metal comprising the internal electrode.

26. The process of claim 5, wherein the controlling of the oxidation-reduction potential of the reaction solution results in controlling the concentration of halogen atom or radicals containing halogen in the reaction solution and the concentration of component (b), the controlling being initiated at the time of mixing components (a) and (b) and continuing to the end point of the process wherein component (b) has been decomposed to provide the desired product.

27. The process of claim 26, wherein the oxidation-reduction potential decreases with the course of the process to the end point.

* * * * *